US009906863B2

(12) United States Patent
Kaetel

(10) Patent No.: US 9,906,863 B2
(45) Date of Patent: Feb. 27, 2018

(54) HEADPHONES AND METHOD FOR PRODUCING HEADPHONES

(71) Applicant: Kaetel Systems GmbH, Munich (DE)

(72) Inventor: Klaus Kaetel, Munich (DE)

(73) Assignee: Kaetel Systems GmbH, Munich (DE)

( * ) Notice: Subject to any disclaimer, the term of this patent is extended or adjusted under 35 U.S.C. 154(b) by 0 days.

(21) Appl. No.: 15/138,141

(22) Filed: Apr. 25, 2016

(65) Prior Publication Data

US 2016/0241962 A1 Aug. 18, 2016

Related U.S. Application Data

(63) Continuation of application No. PCT/PE2014/072883, filed on Oct. 24, 2014.

(30) Foreign Application Priority Data

Oct. 25, 2013 (DE) ..... 10 2013 221 754

(51) Int. Cl.
*H04R 5/033* (2006.01)
*H04R 1/10* (2006.01)
*H04R 1/32* (2006.01)

(52) U.S. Cl.
CPC ..... *H04R 5/033* (2013.01); *H04R 1/1008* (2013.01); *H04R 1/323* (2013.01)

(58) Field of Classification Search
CPC ..... H04R 5/033; H04R 1/1008; H04R 1/323
USPC ..... 381/309, 310, 74, 311
See application file for complete search history.

(56) References Cited

U.S. PATENT DOCUMENTS 5,684,879 A 11/1997 Verdick et al.
2003/0103637 A1* 6/2003 Huang ..... H04R 1/1075 381/309

FOREIGN PATENT DOCUMENTS

| | | | |
|---|---|---|---|
| DE | 2126677 | B | 8/1972 |
| DE | 19819452 | C1 | 1/2000 |
| DE | 102004036355 | A1 | 10/2005 |
| EP | 1071309 | A2 | 1/2001 |
| WO | 2010105280 | A1 | 9/2010 |
| WO | 2012120985 | A1 | 9/2012 |
| WO | 2012130985 | A1 | 10/2012 |

OTHER PUBLICATIONS van Maanen, H., "Requirements for Loudspeakers and Headphones in the "High Resolution Audio" Era", AES 51st International Conference, Helisinki, Finland, Aug. 2013, 10 pages.

* cited by examiner

*Primary Examiner* — David Ton
(74) *Attorney, Agent, or Firm* — Michael A. Glenn; Perkins Coie LLP

(57) ABSTRACT

Headphones include a left loudspeaker element; a right loudspeaker element; and a holder for holding the left loudspeaker element and the right loudspeaker element, such that the loudspeaker elements can be attached to the ears, wherein the left loudspeaker element or the right loudspeaker element includes: a first sound converter; a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones.

16 Claims, 6 Drawing Sheets bending wave converter
schematically in cross section bending wave converter
schematically from the rear

HEADPHONES AND METHOD FOR PRODUCING HEADPHONES

CROSS-REFERENCE TO RELATED APPLICATIONS

This application is a continuation of copending International Application No. PCT/EP2014/072883, filed Oct. 24, 2014, which claims priority from German Application No. 10 2013 221 754.4, filed Oct. 25, 2013, which are each incorporated herein in its entirety by this reference thereto.

BACKGROUND OF THE INVENTION

The present invention relates to headphones and in particular to headphones for reproducing a complete audio scene.

Typically, audio scenes are recorded by using a set of microphones. Each microphone outputs a microphone signal. In an orchestra, for example, 25 microphones are used. Then, an audio engineer carries out a mixture of the 25 microphone output signals, typically into a standardized format, such as a stereo format, a 5.1 format, a 7.1 format, a 7.2 format etc. In a stereo format, the audio engineer or an automatic mixing process generates two stereo channels. For a 5.1 format, mixing results in five channels and one subwoofer channel. Analogously, for example in a 7.2 format, mixing results in seven channels and two subwoofer channels.

When the audio scene is reproduced in a reproduction environment, the mixing result is applied to electrodynamic loudspeakers. In a stereo reproduction system, two loudspeakers exist, wherein the first loudspeaker receives the first stereo channel and the second loudspeaker receives the second stereo channel. In a 7.2 reproduction system, seven loudspeakers exist at predetermined positions and two subwoofers. The seven channels are applied to the respective loudspeakers and the two subwoofer channels are applied to the respective subwoofers.

Above that, there is also headphones reproduction, wherein different approaches exist. Typically, two channels are generated for headphones reproduction, namely a left stereo channel and a right stereo channel, wherein the left stereo channel is reproduced via the left earpiece of the headphones and the right stereo channel via the right earpiece of the headphones. Alternatively, in order to improve spatial perception, binaural processings are performed, wherein by using so-called head-related transfer functions (HRTFs) or binaural room impulse responses (BRIRs), the stereo channels are preprocessed, such that the headphones user does not only have a stereo experience but also a spatial experience.

The usage of a single microphone system on the detection side and a single converter array in headphones on the reproduction side typically neglect the true nature of sound sources. For example, acoustic musical instruments and the human voice are to be differentiated according to how sound is generated and what the emission characteristics are like. Trumpets, trombones, horns and other wind instruments, for example, have strongly directed sound emission. Thus, these instruments emit in an advantageous direction and thus have a high directivity or high quality.

On the other hand, violins, cellos, double basses, guitars, grand pianos, pianos, gongs and similar acoustic musical instruments have a comparatively small directivity or a respective small emission quality factor Q. These instruments use so-called acoustic short circuits when sound is generated. An acoustic short circuit is generated by communication between front and rear of the respective vibrating area or surface.

The human voice generates an average Q factor. Here, the air connection between mouth and nose effects an acoustic short circuit.

String or bow instruments, xylophones, triangles, etc. generate, for example, sound energy in a frequency range up to 100 kHz and additionally have low emission directivity or a low emission quality factor. In particular the tone of a xylophone and a triangle is clearly identifiable, despite their low sound energy and despite their low quality factor, even within a loud orchestra.

Thus, it becomes clear that sound generation by acoustic instruments or other instruments and also by the human voice differs greatly.

When sound energy is generated, air molecules, for example diatomic or triatomic gas molecules are stimulated. There are three different mechanisms that are responsible for this stimulation. In this regard, reference is made to the German patent DE 198 19 452 C1. These three different mechanisms are illustrated in FIG. 5. The first mechanism is translation. Translation describes the linear movement of the air molecules or atoms with respect to the centroid of the molecule, shown at 70 in FIG. 5. The second mechanism is rotation where air molecules or atoms rotate around the centroid of the respective molecule, again indicated by 70. The third mechanism is vibration where the atoms or molecules reciprocate in a specific direction with respect to the centroid 70 of the molecules.

Thus, the sound energy generated by acoustic musical instruments and by the human voice consists of individual mixing ratios of translation, rotation and vibration.

Typically, merely translation is considered. In other words, this means that rotation and vibration are normally not considered during the complete description of the sound energy, which results in significantly perceptible sound quality losses.

On the other hand, the complete sound intensity is defined by a sum of the intensities originating from translation, rotation and vibration.

Above that, different sound sources have different sound emission characteristics. The sound emission generated by musical instruments and generated by the voice generates a sound field, and this sound field reaches the listener via two paths. The first path is the direct sound, where the direct sound portion of the sound field allows exact positioning of the sound source. The second component is the spatial emission. Sound energy emitted in all spatial directions generates a specific sound of instruments or a group of instruments, since this spatial emission cooperates with the room by attenuations, reflections, etc. A specific connection between direct sound and spatially emitted sound is characteristic of all musical instruments and human voice.

WO 2012/120985 A1 discloses a method and an apparatus for detecting and reproducing an audio scene, where sound is detected with a first directivity by microphones arranged between the audio scene and the potential listener. Further, a second detection signal is detected with lower directivity by microphones arranged above or on the side of the audio scene. These two detection signals are separately mixed and processed but are not combined. On the reproduction side, the signals are then output by loudspeaker systems, such as a loudspeaker system in a standard format, where a loudspeaker system comprising both omnidirectional loudspeakers and directional loudspeakers is arranged at each predetermined position of the standard format.

Hereby, it is ensured that the listener can perceive the optimum audio quality, since not only translation and vibration are generated in the reproduction space, but also rotation, which is extremely important for the particular high quality sound perception.

SUMMARY

According to an embodiment, headphones may have: a left loudspeaker element; a right loudspeaker element; and a holder for holding the left loudspeaker element and the right loudspeaker element, such that the loudspeaker elements can be attached to the ears, wherein the left loudspeaker element or the right loudspeaker element may have: a first sound converter; a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones.

According to another embodiment, a method for producing a loudspeaker may have the steps of: connecting a left loudspeaker element with a right loudspeaker element by using a holder, such that the loudspeaker elements can be attached to the ears, wherein the left loudspeaker element or the right loudspeaker element may have: a first sound converter; a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones.

The present invention is based on the knowledge that for optimum high-quality reproduction via headphones, not only a typical headphone converter or standard converter with directed emission is used, but additionally a further converter implemented such that it has an emission which is not directed or less directed than the emission of the standard converter. This second sound converter is implemented as rotation converter or bending wave converter or Manger converter, since these converters are particularly well suited for generating rotation in the surrounding air. Alternatively, a converter for generating directed emission can also generate rotation in the surrounding air, when this converter has an emission direction which is transversal to the emission direction of the standard converter or inclined to the same and still also generates rotation in addition to translation, for example by a freely vibrating membrane without housing. Then, not only direct emission of the standard converter reaches the ear, but also the undirected or less directed emission of the rotation converter, and the ear or the sensors in the ear experience not only translation or vibration but also rotation. In an embodiment of the present invention, the standard converter differs from common headphone converters in that the same comprises a frequency range up to over 50 kHz and typically up to 100 kHz, such that the human ear also experiences excitation above the actually audible spectrum. Thereby, it is ensured that not only the translation is generated via the headphones but also the vibration (high frequencies) and the rotation (bending wave converter), such that an optimum sound experience is also generated via headphones.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
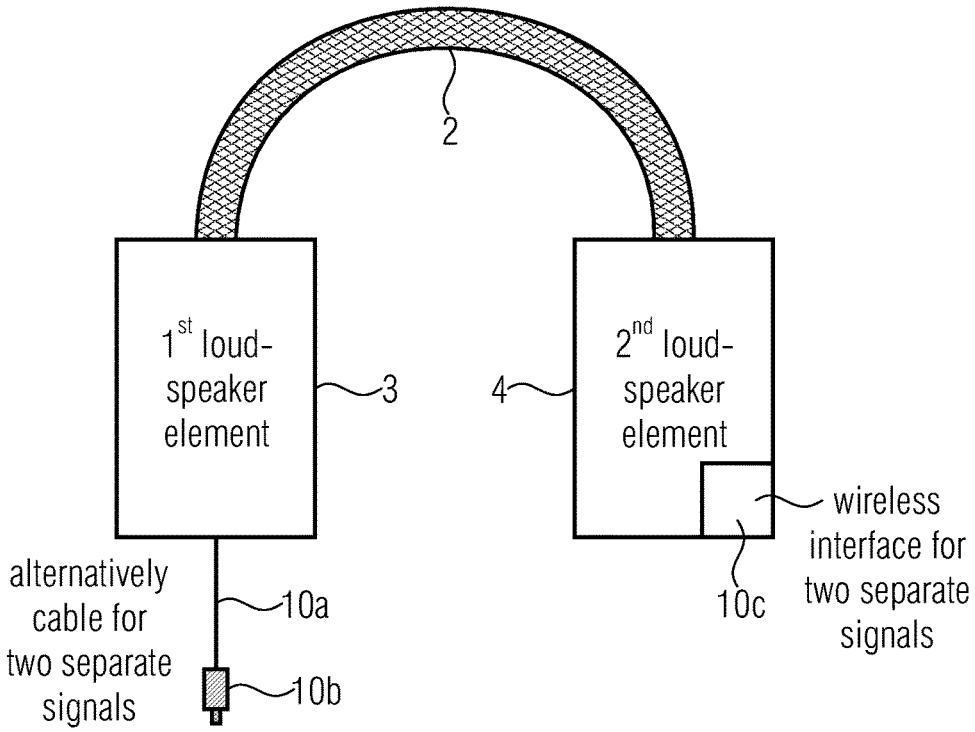
FIG. 1*a* is a schematic illustration of headphones according to an embodiment of the present invention.
Figure 1B:
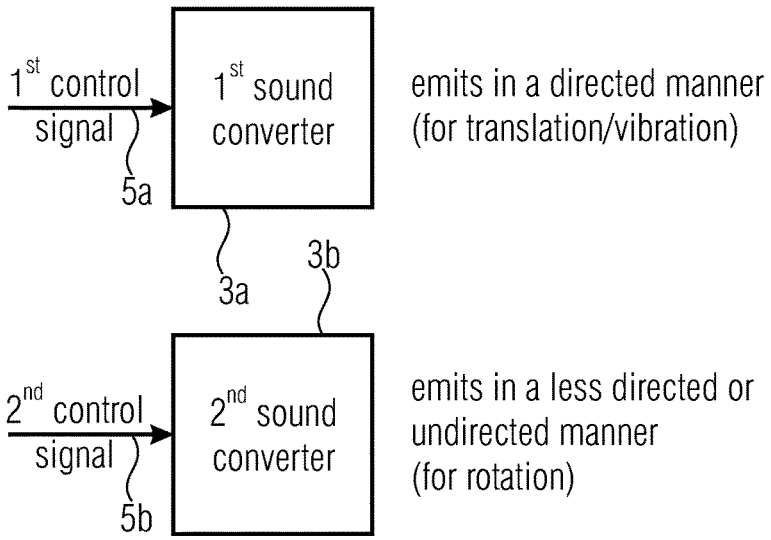
FIG. 1*b* is a detailed illustration of a loudspeaker element of FIG. 1*a;*

FIG. 1*a* shows headphones with a holder 2 for holding a left loudspeaker element or first loudspeaker element 3 and a right loudspeaker element or second loudspeaker element 4. The left loudspeaker element and the right loudspeaker element comprise, as shown in FIG. 1*b*, a first sound converter 3*a* and a second sound converter 3*b*. The first sound converter 3*a* and the second sound converter 3*b* are controlled by different control signals 5*a*, 5*b*, and the two sound converters are implemented such that the first sound converter provides directed emission in the direction of the human ear to which the loudspeaker element can be attached, and that the second converter 3*b* provides no or less directed emission than the first converter in the direction of the human ear.

Figure 1C:
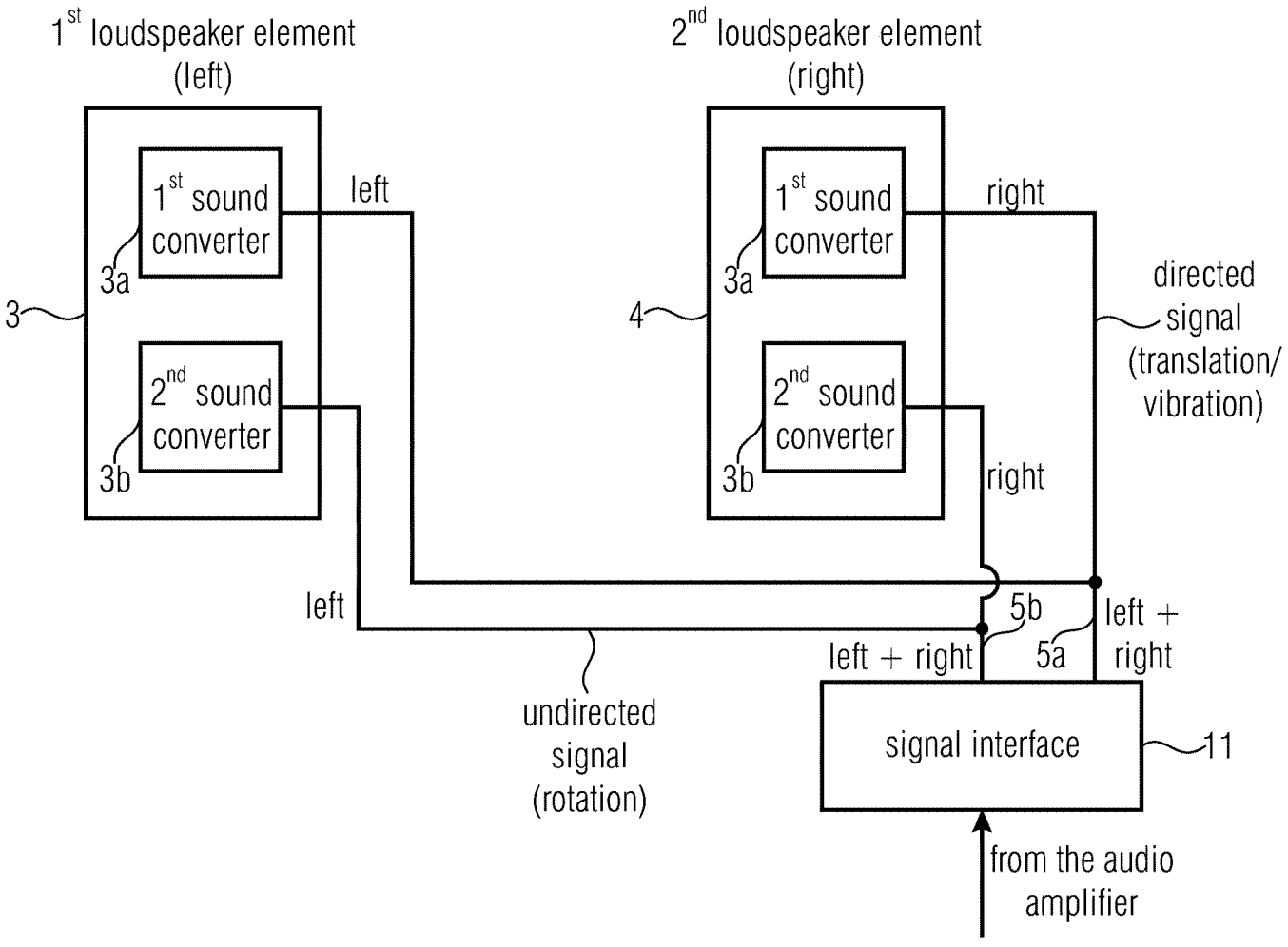
FIG. 1*c* is an illustration analogous to FIG. 1*b*, but with connectivity or signal routing to the individual sound converters of the loudspeaker elements.

As shown in FIG. 1*a*, the loudspeaker includes a connecting cable 10*a* with a connecting plug 10*b* or a connecting socket, or additionally or alternatively a wireless interface 10*c*. The cable with the plug or the socket or the wireless interface are implemented such that same provide two separate and different control signals for the first sound converter and the second sound converter of the two loudspeaker elements. Advantageously, as shown in FIG. 1*c*, the first control signal for the first (directed) sound converter 5*a* is a two-channel signal, namely a signal for the left channel and a signal for the right channel, when the same leaves a signal interface 11 which is a connection between audio amplifier and loudspeaker element. Then, typically within the headphones, the two channel signal branches into a left channel for the left loudspeaker element 3 (two separate left channels for the sound converter in 3) and a right channel for the right loudspeaker element 4 (two separate right channels for the sound converter in 4).

In an embodiment, the first sound converter is a single converter or a single converter array. The first sound converter is implemented such that the same comprises a frequency range greater than 50 kHz and advantageously even greater than 90 kHz, such that frequencies up to 50 or 90 kHz or even 100 kHz are emitted with amplitudes that are equal to or greater than half of a maximum amplitude in the frequency range of, for example, 0 to 20 kHz or 0 to 50 or 0 to 90 kHz or 100 kHz.

The first sound converter 3*a* is implemented as standard sound converter, wherein a standard sound converter is a sound converter of the group of electromagnetic, electrodynamic, isodynamic or orthodynamic or magnetostatic sound converters, balanced armature sound converters, electrostatic sound converters or piezoelectric sound converters. Normally, typical common headphone converters can be used.

In order to ensure good rotation generation with high efficiency, the second sound converter 3*b* of FIG. 1*b* is implemented as Manger converter or bending wave converter with a partly or completely circumferentially clamped membrane. Bending wave converters typically have a membrane which does not have to be particularly stiff, in contrast to other loudspeaker structure types, but is flexible and has high inner attenuation. Above that, the edge of the membrane is typically terminated with its characteristic impedance, such that no reflections occur on the edge. Further variations of the bending wave converter are known under the name "Distributed Mode Loudspeaker" (DML). Here, stiff light plates that are excited by so-called exciters are used for construction. With the bending wave converter, basically any surface can be used as membrane.

Figure 2:
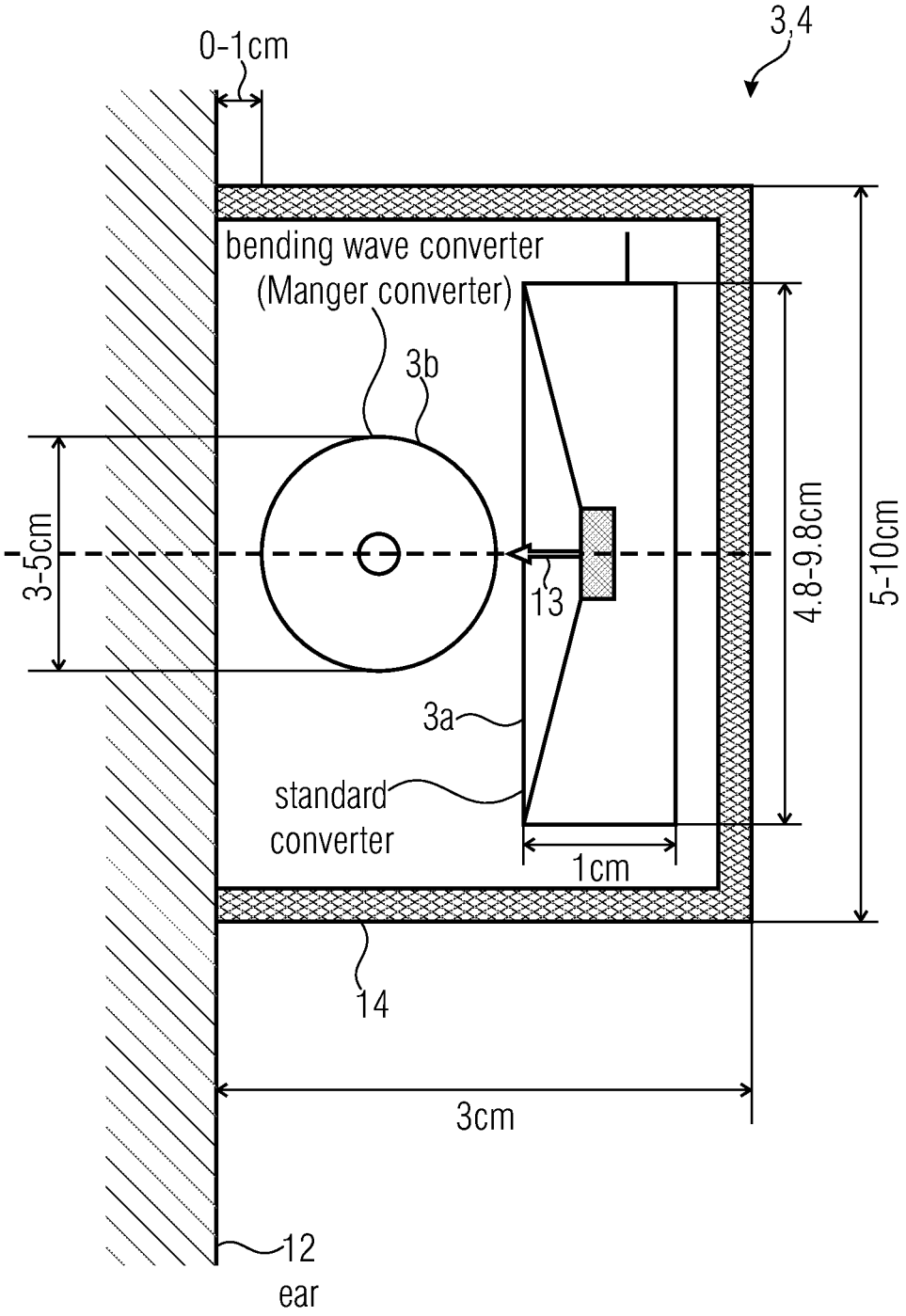
FIG. 2 is a cross-section through a loudspeaker element according to an embodiment of the present invention with standard sound converter and perpendicularly arranged bending wave converter (Manger converter)

FIG. 2 shows an embodiment of a loudspeaker element, which can either be the loudspeaker element 3 or the loudspeaker element 4. The first sound converter 3*a* is schematically illustrated as electrodynamic sound converter. The second sound converter 3*b* is illustrated as bending wave converter. The bending wave converter has a diameter between 3 and 5 cm. The first (conventional) sound converter has a depth of 0.5 to 1.5 cm and typically a depth of 1 cm and a width of (in square or rectangular implementations) or a diameter (in circular implementation) of 4.8 to 9.8 cm. The whole loudspeaker element includes a headphone earpiece 14 illustrated in cross-section having a width (in rectangular or square implementation) or a diameter (with circular implementation) of 5 to 10 cm and a depth of 3 cm. The first sound converter 3*a* emitted in a directed manner is arranged further apart from the ear in the ear piece 14, and the bending wave converter 3*b* is arranged between the conventional converter and the ear shown schematically at 12 in FIG. 2. As shown in FIG. 2, the first sound converter has a first main emission direction in the direction of the ear as illustrated by arrow 13. In contrast, the main emission direction of the second sound converter 3*b* is out of the drawing plane or into the drawing plane, i.e. perpendicular to the sound emission direction 13 of the conventional converter. This arrangement is advantageous due to the most efficient sound generation. Alternatively, the angle can also be between 45° and 135° between the main emission directions of the second converter 3*b* and the first converter 3*a* and most advantageously the angle is between 80 and 100°. The loudspeaker can be implemented as supraaural or circumaural loudspeaker, i.e. with a supraaural or circumaural headphone earpiece, wherein in FIG. 2 a circumaural headphone earpiece 14 is illustrated. In any case, both sound converters are arranged within the headphone earpiece, independent of whether the same is supraaural or circumaural. However, it is advantageous to use a circumaural headphone earpiece as shown in FIG. 2, since then the headphone earpiece can be implemented in an attenuating manner, such that the direct sound emitted in the emission direction of the bending wave converter 3*b* or the second sound converter 3*b* first impinges on the earpiece 14 and is attenuated there, such that merely indirect sound or the rotation generated by the sound converter reaches the ear 12. On the other hand, the directly emitted sound of the standard converter 3*a* is not attenuated by the absorption material of the headphone earpiece 14 but passes through the bending wave converter 3*b* or along the same into the ear 12 of the user of the headphones.

The first sound converter 3*a* is implemented such that the same generates the translation/vibration and transports the same to the ear 12, while the second sound converter is implemented such that it generates the rotation which then reaches the ear 12 from the area enclosed by the headphone.

Figure 3A:
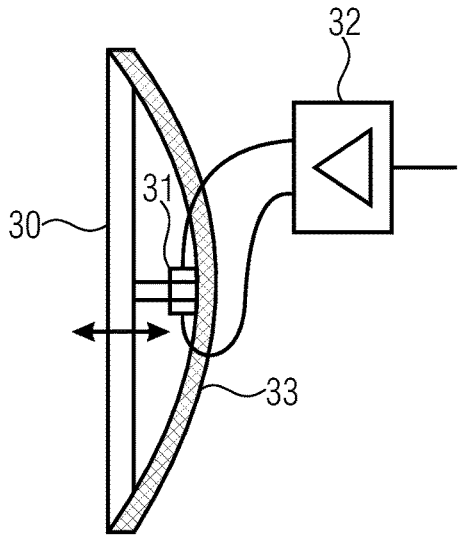
FIG. 3*a* is a lateral sectional view of the bending wave converter of FIG. 2.
Figure 3B:
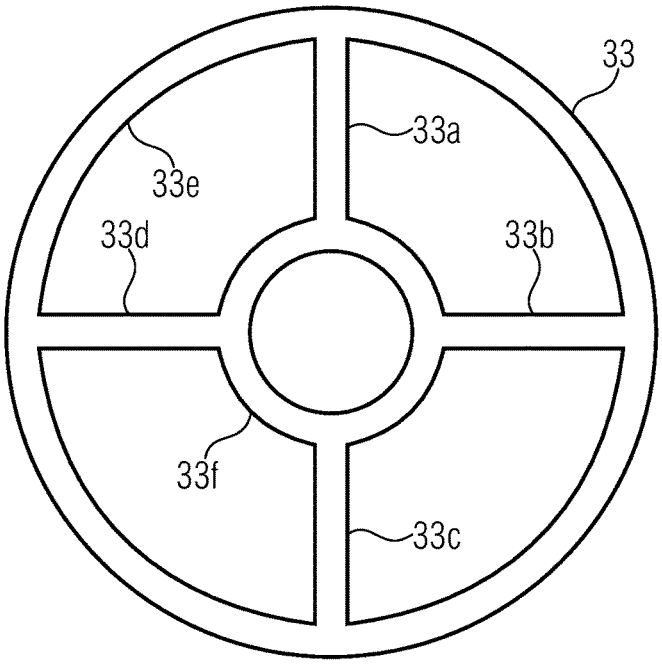
FIG. 3*b* is a rear view of the bending wave converter of FIG. 2 or FIG. 3*a;*

FIG. 3*a* shows the bending wave converter 3*b* illustrated in top view in FIG. 2 in lateral cross-section. Thus, the membrane 30 actuated by an actuator mechanism 31 can be seen, wherein the actuator mechanism 31 is controlled by an amplifier 32 obtaining the audio signal which is to be output. The amplifier can be arranged within the headphones or also outside the headphones, for example as audio amplifier in a music system. Above that, the bending wave converter of FIG. 3*a* comprises a membrane carrier 33, which is, for example, arched, i.e. dome shaped, but can also have any other shape for holding the membrane 30 and the actuator 31. A top view from the rear onto the bending wave converter is shown in FIG. 3*b* in order to illustrate the membrane carrier 33 in more detail. The same comprises ridges 33*a*, 33*b*, 33*c*, 33*d* connecting an external membrane holder 33*a* to an actuator holder 33*f*. While four ridges are illustrated in FIG. 3*b*, two, three or more than four ridges can also be used. In any case, it is advantageous to select a relatively open structure so that the arrangement of the bending wave converter directly between the standard converter 3*a* and the ear 12, as shown in FIG. 2, presents as little attenuation as possible for the sound energy emitted by the standard converter 3*a*. On the front, the sound energy simply passes the standard converter since the same is implemented at a right angle to the standard converter in this specific array, and on the rear side the sound energy merely has to pass through the dome-like membrane holder 33, which, however, is not problematic, since the same is an open structure with ridges 33*a* to 33*d*.

It should be noted that the bending wave converter 3*b* does not necessarily have to be implemented perpendicularly to the standard converter, but can also be implemented horizontally to the standard converter or in any position which the bending wave converter assumes when the membrane is rotated along an axis defined by arrow 13. In other words, the arrangement of the two sound converters is such that the first sound converter puts the surrounding air into a first amount of translation or vibration and a second amount of rotation. Further, the second sound converter is implemented or arranged to put the surrounding air into a third amount of translation or vibration and a fourth amount of rotation. The third amount is zero or (at least) less than the first amount. Further, the second amount is zero or (at least) less than the fourth amount. This means that the standard converter mainly generates directed sound energy and the second sound converter 3*b* mainly generates rotational energy. The standard converter is implemented as dynamic sound converter basically structured like a loudspeaker. An angular coil (also referred to as moving coil) is adhered on the rear of the membrane, which moves in an air gap of a permanent ring magnet. This converter provides high reproduction quality, is mechanically very robust, necessitates only little operating voltage and has a significantly lower purchase price compared to electrostatic converters.

In a method for producing the headphones, a holder for holding the left loudspeaker element and the right loudspeaker element is connected to the left loudspeaker element and the right loudspeaker element, wherein the left loudspeaker element and the right loudspeaker element each comprise the first sound converter and the second sound converter, which emit in a differently directed manner or where the second sound converter is implemented and arranged to generate a significant amount of rotational energy in the headphone volume.

In the following, generation of the different signals will be discussed with reference to FIG. 4.

Figure 4:
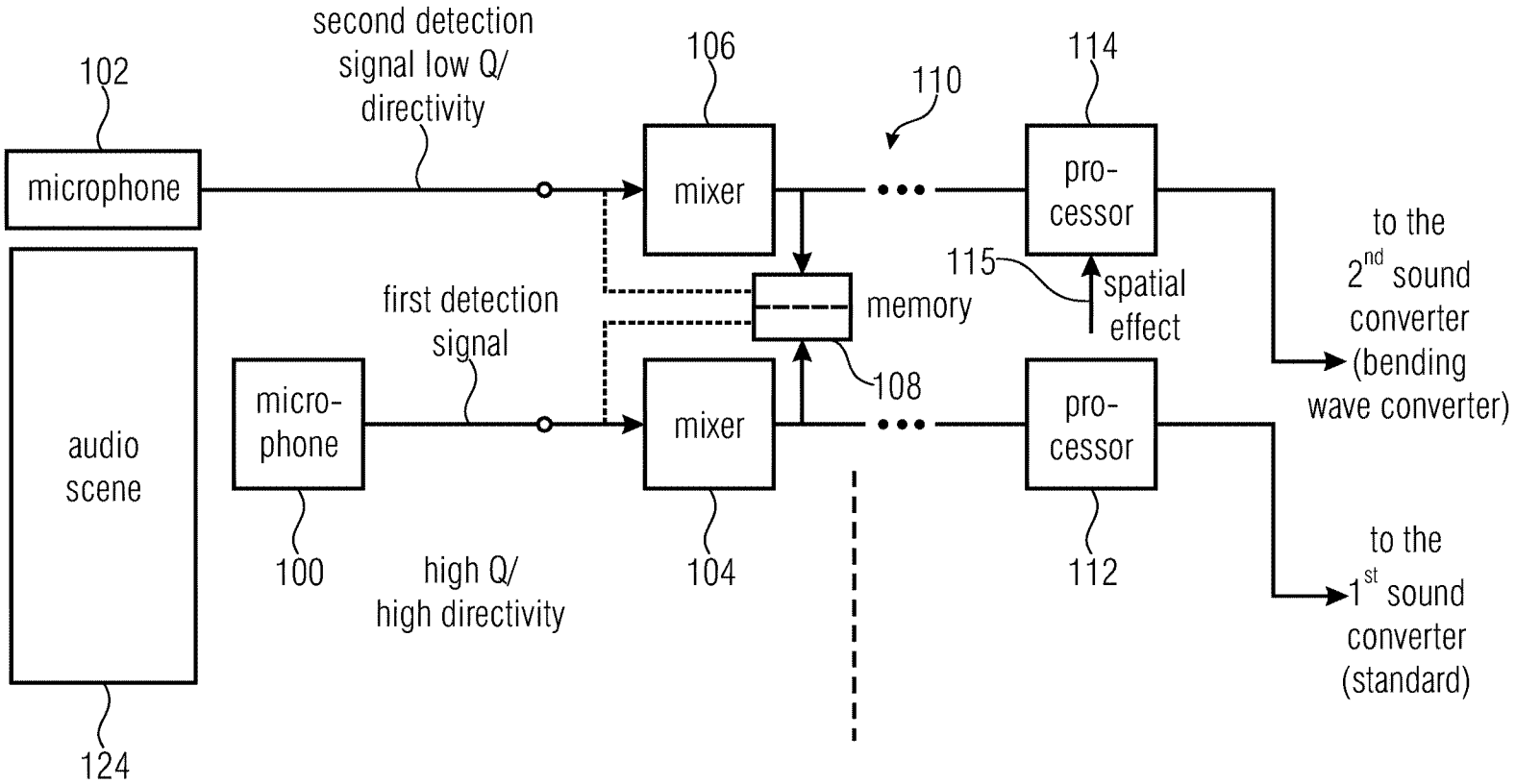
FIG. 4 is an illustration of the signal generating or signal rendering chain for generating the stereo signals for the first sound converter and the second sound converter.
Figure 5:
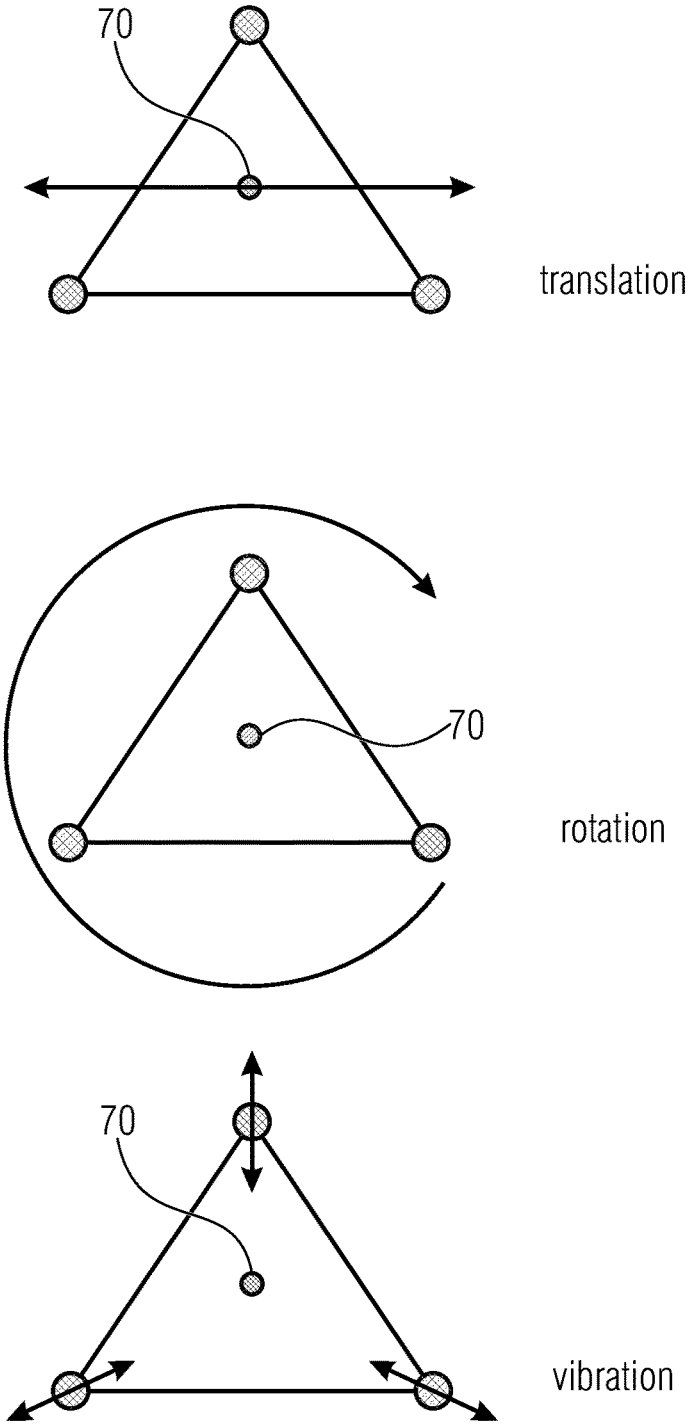
FIG. 5 is a schematic illustration of the three different sound intensities translation, rotation and vibration.

FIG. 4 shows different microphone sets 100, 102. Each microphone set 100, 102 includes a number of microphones, for example 10 or even more than 20 individual microphones. Thus, the first detection signal includes 10 or 20 or more individual microphone signals. This also applies for the second detection signal. These microphone signals are then typically mixed down within the mixers 104, 106 to obtain respectively mixed signals with a respective lower number of individual signals. When, for example, the first detection signal had 20 individual signals and the mixed signal has 5 individual signals, each mixer performs a downmix from 20 to 5. Above that, as shown in FIG. 4, a specific placement of the microphone sets 102, 100 with respect to an audio scene 124 is performed. The microphones are mainly placed above or on the side of the audio scene 124, as illustrated in 102 in order to detect the second detection signal with lower quality or lower directivity. On the other hand, the microphones of the first microphone set 100 are positioned in front of the audio scene 124 or between the audio scene 124 and a typical listener position in order to detect the directed sound energy emitted by the audio scene 124.

The mixed signals are either stored separately, as illustrated at 108, and/or transmitted to a reproduction system via a transmission path 110, in order to be processed by processors 112, 114, wherein these processors are, for example, amplifiers, mixers and/or binaural processors in order to provide the signal to the first sound converter, which will typically be a stereo signal with two channels, and the signal to the second sound converter, which will also be a stereo signal with two channels. As illustrated in FIG. 4 at 115, the processors 112, 114 can also perform reverberation, wherein this reverberation is particularly advantageous for the rotation signal, but not for the directed signal.

Thus, the inventive headphones are implemented to generate all three transmission mechanisms translation, vibration and rotation or to transmit the same to the ear. For transmitting translation and vibration, standard sound converters having an extended high-frequency range, possibly up to 100 kHz, are advantageous. Also, several converters can be used for individual frequency ranges for transmitting the whole spectrum. For transmitting rotation, a separate sound converter, namely the second sound converter of FIG. 1*b* is used.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Headphones, comprising:

a left loudspeaker element;

a right loudspeaker element; and a holder for holding the left loudspeaker element and the right loudspeaker element, such that the loudspeaker elements can be attached to the ears, wherein the left loudspeaker element or the right loudspeaker element comprises:

a first sound converter;

a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones, wherein the first sound converter comprises at least one converter of a group of converters comprising an electromagnetic converter, an electrodynamic converter, an isodynamic or orthodynamic or magnetostatic converter, a balanced armature sound converter, an electrostatic converter and a piezoelectric converter, and wherein the second sound converter is a Manger converter or a bending wave converter with a membrane.

2. Headphones according to claim 1, wherein the first sound converter can be excited with a first control signal, wherein the second sound converter can be excited with a second control signal, wherein the first control signal and the second control signal are different to one another or comprise a left stereo channel and a right stereo channel each.

3. Headphones according to claim 1, wherein the first sound converter is a single converter array or only comprises a single converter, wherein the first sound converter is implemented to comprise a frequency range of more than 50 kHz, such that frequencies at 50 kHz are emitted with amplitudes that are equal to or greater than half of a maximum amplitude in the frequency range of 0 to 49.99 kHz.

4. Headphones according to claim 1, wherein the second sound converter is arranged between the ear and the first sound converter.

5. Headphones according to claim 1, wherein the first sound converter comprises a first main emission direction in the direction of the ear, wherein the second sound converter comprises a second main emission direction comprising an angle between 45° and 135° to the first main emission direction.

6. Headphones according to claim 5, wherein the angle between the first main emission direction and the second main emission direction is between 80° and 100°.

7. Headphones according to claim 1, wherein the left loudspeaker element and the right loudspeaker element are implemented as supraaural or circumaural headphone earpieces, wherein both the first sound converter and the second sound converter are arranged in each headphone earpiece.

8. Headphones according to claim 1, wherein the left loudspeaker element and the right loudspeaker element comprise a headphone earpiece comprising an enclosure whose depth is between 2.5 and 3.5 cm and whose width or diameter is between 5 cm and 10 cm.

9. Headphones according to claim 1, wherein the second sound converter comprises a circular membrane comprising a diameter between 3 and 5 cm, or wherein the first sound converter comprises a depth between 0.1 and 1.5 cm and a width or a diameter between 4 cm and 9 cm, or wherein the second sound converter is at the most 1 cm apart from the ear when the headphones are worn in their operating position.

10. Headphones according to claim 1, wherein the left loudspeaker element or the right loudspeaker element comprises a headphone earpiece, the headphone earpiece comprising an absorption material, and wherein the left loudspeaker element or the right loudspeaker element is implemented to at least partly absorb direct sound emitted by the second sound converter by the absorption material of the headphone earpiece of the left loudspeaker element or the right loudspeaker element.

11. Headphones according to claim 1, wherein the second sound converter comprises a reverberator to reverberate an electrical signal that controls the second sound converter, before the same is converted into acoustic energy by the second sound converter.

12. Headphones according to claim 1, wherein the first sound converter is implemented to put surrounding air into a first amount of translation or vibration and a second amount of rotation, and wherein the second sound converter is implemented to put the surrounding air into a third amount of translation or vibration and a fourth amount of rotation, wherein the third amount of translation or vibration is zero or less than the first amount of translation or vibration, and wherein the second amount of rotation is zero or less than the fourth amount of rotation.

13. Headphones according to claim 1, comprising a connecting cable and a plug or socket, wherein the connecting cable and the plug or socket are implemented to provide two separate and different control signals for the first sound converters and the second sound converters of the two loudspeaker elements or comprising a wireless interface, wherein the wireless interface is implemented to provide two separate and different control signals for the first sound converters and the second sound converters of the two loudspeaker elements.

14. Method for producing a loudspeaker, comprising:

connecting a left loudspeaker element with a right loudspeaker element by using a holder, such that the loudspeaker elements can be attached to the ears, wherein the left loudspeaker element or the right loudspeaker element comprises:

a first sound converter;

a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones, wherein the first sound converter comprises at least one converter of a group of converters comprising an electromagnetic converter, an electrodynamic converter, an isodynamic or orthodynamic or magnetostatic converter, a balanced armature sound converter, an electrostatic converter and a piezoelectric converter, and wherein the second sound converter is a Manger converter or a bending wave converter with a membrane.

15. Headphones, comprising:

a left loudspeaker element;

a right loudspeaker element; and a holder for holding the left loudspeaker element and the right loudspeaker element, such that the loudspeaker elements can be attached to the ears, wherein the left loudspeaker element or the right loudspeaker element comprises:

a first sound converter;

a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones, wherein the first sound converter is a single converter array or only comprises a single converter, wherein the first sound converter is implemented to comprise a frequency range of more than 50 kHz, such that frequencies at 50 kHz are emitted with amplitudes that are equal to or greater than half of a maximum amplitude in the frequency range of 0 to 49.99 kHz, or wherein the second sound converter is arranged between the ear and the first sound converter, or wherein the second sound converter comprises a circular membrane comprising a diameter between 3 and 5 cm, or wherein the first sound converter comprises a depth between 0.1 and 1.5 cm and a width or a diameter between 4 cm and 9 cm, or wherein the second sound converter is at the most 1 cm apart from the ear when the headphones are worn in their operating position.

16. Method for producing a loudspeaker, comprising:

connecting a left loudspeaker element with a right loudspeaker element by using a holder, such that the loudspeaker elements can be attached to the ears, wherein the left loudspeaker element or the right loudspeaker element comprises:

a first sound converter;

a second sound converter, wherein the first sound converter is implemented such that the first sound converter provides directed emission in the direction of an ear in the operating position of the headphones, and the second sound converter is implemented such that the second sound converter provides no or less directed emission than the first sound converter in the direction of the ear in the operating position of the headphones, wherein the first sound converter is a single converter array or only comprises a single converter, wherein the first sound converter is implemented to comprise a frequency range of more than 50 kHz, such that frequencies at 50 kHz are emitted with amplitudes that are equal to or greater than half of a maximum amplitude in the frequency range of 0 to 49.99 kHz, or wherein the second sound converter is arranged between the ear and the first sound converter, or wherein the second sound converter comprises a circular membrane comprising a diameter between 3 and 5 cm, or wherein the first sound converter comprises a depth between 0.1 and 1.5 cm and a width or a diameter between 4 cm and 9 cm, or wherein the second sound converter is at the most 1 cm apart from the ear when the headphones are worn in their operating position.

* * * * *